US007175071B1

(12) United States Patent
Slagle et al.

(10) Patent No.: US 7,175,071 B1
(45) Date of Patent: Feb. 13, 2007

(54) SECURE PACKAGE RECEPTACLE

(76) Inventors: David E. Slagle, 3958 La Rosa Ct., Grove City, OH (US) 43123; Jerry E. Baxtron, 435 Basswood Rd., Columbus, OH (US) 43207

( * ) Notice: Subject to any disclaimer, the term of this patent is extended or adjusted under 35 U.S.C. 154(b) by 0 days.

(21) Appl. No.: 11/132,592

(22) Filed: May 20, 2005

(51) Int. Cl.
*B65G 11/04* (2006.01)

(52) U.S. Cl. ..... 232/45; 232/17; 232/43.1; 220/833

(58) Field of Classification Search ..... 232/45, 232/17, 43.1, 44; 220/908, 908.1, 908.3, 220/676, 833; 16/412; 70/63
See application file for complete search history.

(56) References Cited

U.S. PATENT DOCUMENTS 445,497 A * 1/1891 Catudal et al. ..... 232/47
1,009,146 A * 11/1911 Heath ..... 232/23
2,769,516 A * 11/1956 Hensley, Jr. ..... 194/210
3,659,778 A * 5/1972 Saultz et al. ..... 232/43.1
5,435,484 A * 7/1995 Carlson ..... 232/47
5,624,071 A 4/1997 Sosan
6,056,148 A * 5/2000 Ferguson et al. ..... 220/676
6,378,769 B1 4/2002 Wolgamot
6,644,543 B2 11/2003 Cox et al.
6,968,993 B1 * 11/2005 Russell ..... 232/17

* cited by examiner

*Primary Examiner*—William L. Miller
(74) *Attorney, Agent, or Firm*—Crossley Patent Law; Mark A. Crossley

(57) ABSTRACT

A secure package receptacle comprising a parallelepiped box having a flushly fitted lockable access door hingedly attached within the front of the box, a recessed handle within the access door, a lid pivotally secured and flushly fitted to the box top, the lid beveled edge fitting a coplanar beveled edge of the top, a recessed handle within the lid and a lid lock accessible from the box interior, the recessed handles having handle surrounds preventing inclement weather invasion, whereby received packages are securely retained within the interior of the box until accessed from the access door.

20 Claims, 4 Drawing Sheets

SECURE PACKAGE RECEPTACLE

BACKGROUND OF THE INVENTION

Secure package and mail delivery has increasingly become a problem. Not only are the delivered mail and items sometimes subject to the elements, theft and tampering is certainly common. While various container designs have attempted to address the problem, the designs have often unsuccessfully met the challenges encountered. Challenges include (a) simplicity in design, (b) cost effectiveness, (c) size limitations, (d) secure attachment to prevent container movement or theft, (e) undesired access to the container, and even (e) safety concerns. Repeated delivery attempts must be avoided such that delivery personnel save money, time, fuel, and also to insure that the item is delivered and not returned. What is needed is a basic, cost effective, secure container such that the device is accessed by the delivery person, then secure until the responsible party removes the delivered items. The container should receive large items as well as regular mail and oversized envelopes. The container should be large enough to receive most boxes and the like and also secure against harming an inadvertently trapped child. The present invention solves the problems associated with such a device in a unique way.

FIELD OF THE INVENTION

The invention relates to a device for securely receiving delivered items in absentia and securing those items until removed by a responsible party.

SUMMARY OF THE INVENTION

The general purpose of the secure package receptacle, described subsequently in greater detail, is to provide a secure package receptacle which has many novel features that result in an improved secure package receptacle which is not anticipated, rendered obvious, suggested, or even implied by prior art, either alone or in combination thereof.

To accomplish this, the invention comprises a secure package receptacle. The receptacle comprises a parallelepiped box having a flushly fitted lockable access door. One example fits the access door to the front of the box. Other examples offer the access door located on either side of the box. A concealed hinge attaches the access door to the box. The hinge is a piano hinge in one example. Another example features a wire hinge. A recessed handle is disposed within the access door. The handle is at an opposite side of the door from the hinge. A lid is pivotally secured and flushly fitted to the box top. The lid further comprises a lid beveled edge fitting a parallel beveled edge of the top. The lid beveled edge is on a side of the lid opposite the hinge. The lid beveled edge is about 30 degrees from vertical. The top beveled edge is about 60 degrees from vertical. The lid beveled edge fits the top beveled edge of the box top. A seal is employed to seal the box against moisture invasion through the lid. The recessed handle is disposed within the lid. The lid lock is accessible from the box interior. The lid lock further comprises a plunger extended by a compression spring. The plunger has a plunger bevel at the end opposite the spring. The plunger bevel interacts with the top beveled edge such that the box top can close with the plunger extended. The box is therefore sealed against incursion once closed. The lid lock further comprises a release whereby the plunger is held retracted against the spring loaded extension. The box can therefore be closed and still not locked until the desired trip of the release. Access to the box after the lid is closed is via the front access door. Further, the lid lock has a twist knob such that the lock is opened from the interior of the box. In a case of inadvertent child entrapment within the box, the knob can be turned from inside, allowing escape. The recessed handles have handle surrounds preventing inclement weather invasion of the box. The access door handle surround is optionally fitted with cutouts such that air is allowed to circulate in and out of the box. A further optional example of the invention is fitted with handles on the sides of the box that are identical to the handle on the access door. The side handles provide for lifting the box as needed and for further ventilation. The design of the invention incorporating the air circulation and the latch knob insure that no danger exists in harming anyone inadvertently trapped within the invention. Packages are received and securely retained within the interior of the box. Typically, a delivery person either finds the box lid open or opens the unlocked lid. The underside of the lid is printed with instructions. The instructions, in one example, read "Attention, delivery person. After placing packages in the security box flip the small switch (also termed lock release) button and close the lid to secure your delivery". The printing is not constrained to this exact content in all examples of the invention. The printing advises a delivery person of the wishes of the party responsible for the box. The printing informs the delivery person how to secure the box after delivery. The box also incorporates a mail slot for the receipt of regular mail, FedEx, Airborne, UPS, and other such envelopes. All deliveries are thereby secured against theft, tampering, and weather until the access door is unlocked and the items removed.

The invention is, in one example, made of plastic. Other appropriate polymers, fiberglass, metals, and the like are also used when needed or when most cost effective. The invention is not limited to size. The invention is complete with mounting bolts or lags bolts and anchors as needed. The invention comes in a variety of colors. One example includes a flag within the chosen exterior surface of the invention. Other examples include logos and advertising on the various outer surfaces of the invention. The invention provides a basic design for securely receiving and storing received goods until the responsible party removes the goods.

Thus has been broadly outlined the more important features of the secure package receptacle so that the detailed description thereof that follows may be better understood and in order that the present contribution to the art may be better appreciated.

Numerous objects, features and advantages of the secure package receptacle will be readily apparent to those of ordinary skill in the art upon reading the following detailed description of presently preferred, but nonetheless illustrative, examples of the secure package receptacle when taken in conjunction with the accompanying drawings. In this respect, before explaining the current examples of the secure package receptacle in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the secure package receptacle. It is therefore important that the claims be regarded as including such equivalent constructions insofar as they do not depart from the spirit and scope of the present invention.

Objects of the secure package receptacle, along with various novel features that characterize the invention are particularly pointed out in the claims forming a part of this disclosure. For better understanding of the secure package receptacle, its operating advantages and specific objects attained by its uses, refer to the accompanying drawings and description.

DETAILED DESCRIPTION OF THE DRAWINGS

With reference now to the drawings, and in particular FIGS. 1 through 4 thereof, example of the secure package receptacle employing the principles and concepts of the present invention and generally designated by the reference number 10 will be described.

Figure 1:
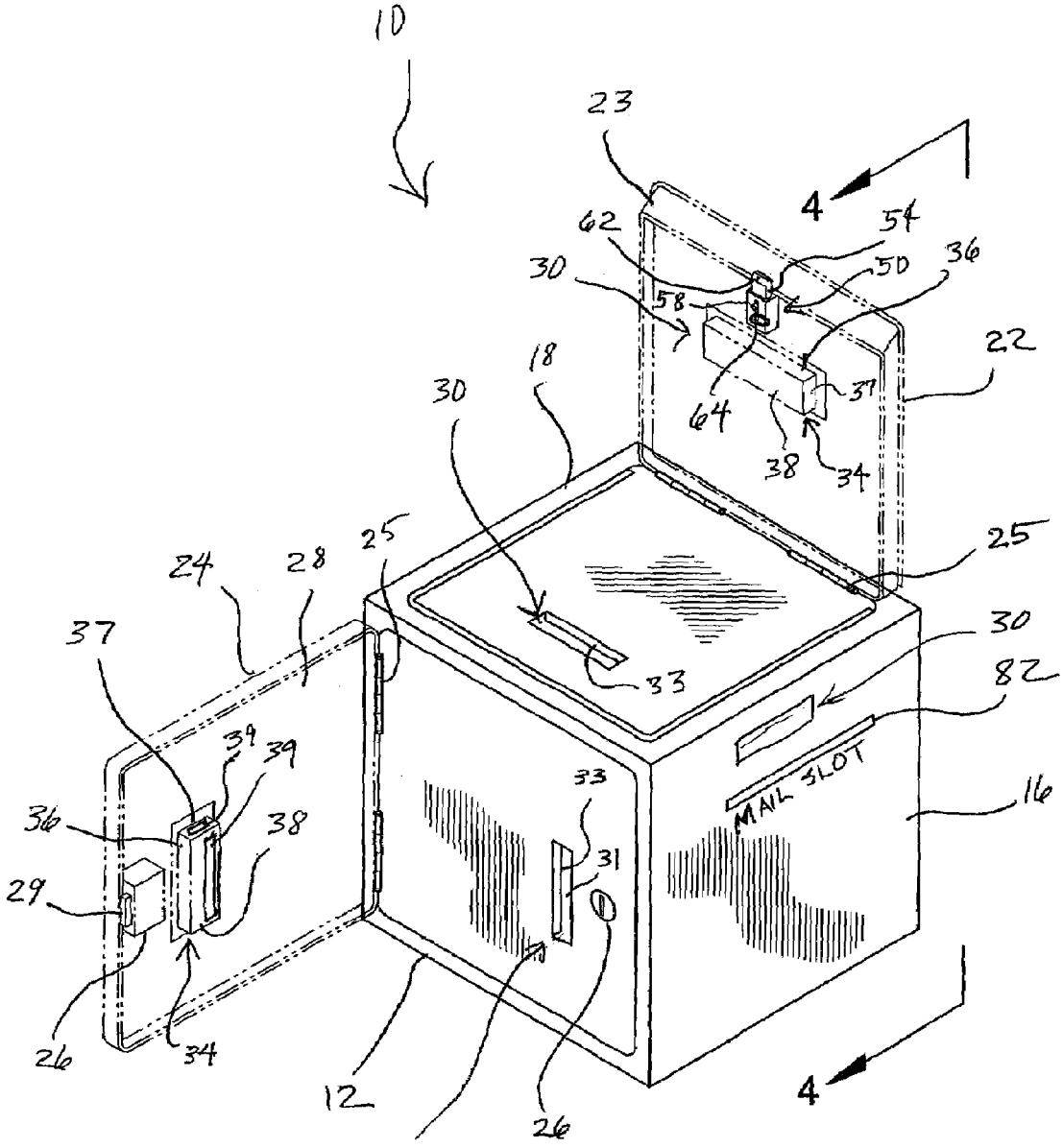
FIG. 1 is a perspective view of the invention.

Referring to FIG. 1, the invention 10 comprises a secure package receptacle, the receptacle comprises a parallelepiped box having a spaced apart top 18 and bottom (not shown). The box further comprises a spaced apart front 12 and back 14. The box further comprises two spaced apart sides 16. An interior 21 is thereby defined. An access door 24 is disposed within the front 12 of the box. The access door 24 is fitted flush with the box front 12. A recessed handle 30 is disposed within the access door 24. The handle 30 is proximal to one vertical edge of the access door 24. The handle 30 further comprises a handle entry 31. A grab 33 is disposed within the entry 31. A handle surround 34 shields the interior 21 of the box against the invasion of inclement weather elements. The handle surround 34 further comprises two spaced apart handle surround sides 36 and two spaced apart handle surround ends 37. The handle surround back 38 connects the handle surround sides 36 and the handle surround ends 37. The handle surround back 38 is further comprised of an optional surround cutout 39. The upper surround end 37 is further comprised of an optional surround cutout 39. The cutouts 39 provide for the entry of air into the interior 21 of the invention 10. Recessed handles 30 are also disposed on the upper portion of each side 30. Recessed handles 30 are further comprised of handle surrounds 34 with surround cutouts 39. The door lock 26 locks the access door 24. The door lock 26 employs the lock arm 29 for locking the access door 24. The door lock 26 is on the door back side 28 of the access door 24. A hinge 25 pivotally attaches the access door 24 to the front 12 of the box. The hinge 25 is vertically disposed on the side of the access door 24 opposite the recessed handle 30. The hinge 25 is concealed whereby the hinge 25 is not visible from the outside of the invention 10. The door lock 26 for the access door 24 is disposed proximally to the handle 30. The handle 30 is interiorly shielded by the handle surround 34. A lid 22 secures the top 18 of the box. The lid 22 is fitted with a seal (not shown) which seals against moisture invasion. The lid 22 has four sides. The lid 22 fits flush with the box top 18. A lid hinge 25 pivotally attaches a first side of the lid 22 to the box top 18. The lid beveled edge 23 is disposed on a side opposite the first side of the lid 22. The lid beveled edge 23 is about 30 degrees from vertical. A recessed handle 30 is disposed within the lid 22. The handle 30 is disposed proximal to the lid beveled edge 23. The grab 33 is within the handle 30. A lid lock 50 is disposed proximally to the edge of the underside of the lid 22. The lid lock 50 is adjacent to the lid beveled edge 23. The lid lock 50 comprises a lock plunger 54. The lock plunger 54 further comprises a plunger bevel 62. Further, the lid lock 50 comprises a knob 64 on the end of the lock 50 opposite the plunger 54. The knob 64 provides for unlocking the lock 50. The release 58 provides for holding the plunger 54 in a retracted state. The release 58 also provides for releasing the plunger 54 in preparation of locking the lid 22 to the box top 18 when the lid 22 is closed. A handle surround 34 is disposed medially from the lid lock 50. The handle surround 34 prevents invasion of inclement weather elements (not shown) into the interior 21 (FIG. 3) of the invention 10. The mail slot 82 is disposed within a side 16 of the invention 10. The mail slot 82 is labeled.

Figure 2:
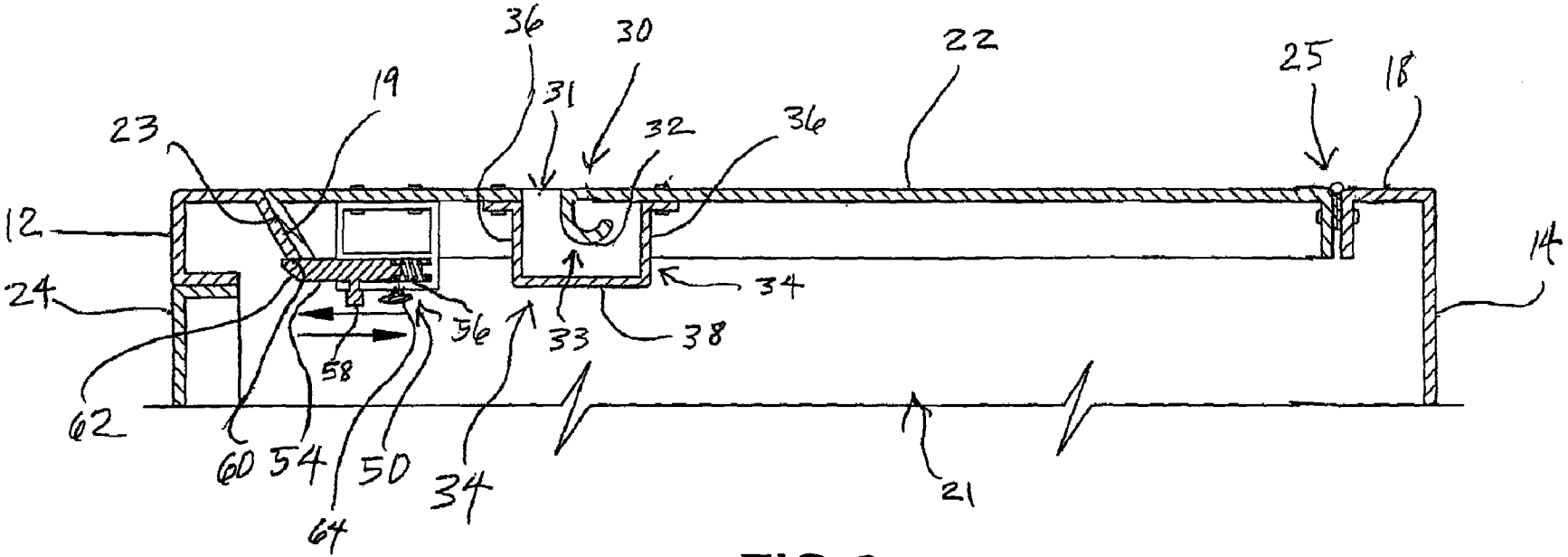
FIG. 2 is a lateral cross sectional view of the top of the invention, with flush lid received and latched with the box top.

Referring to FIG. 2, the top beveled edge 19 of the box top 18 receives the lid beveled edge 23. The lid hinge 25 pivotally connects the lid 22 to the top 18. The lid hinge 25 is concealed to be invisible from the exterior of the invention 10. The top beveled edge 19 of the box top 18 is about 60 degrees from vertical. The top beveled edge 19 is parallel to the lid beveled edge 23. The lid lock 50 is affixed to the underside of the lid 22. The lid lock 50 comprises a compression spring 56 acting to extend the lock plunger 54. The plunger 54 is further comprises of a plunger bevel 62 on an end of the plunger 54 opposite the compression spring 56. The plunger bevel 62 provides for lid 22 closure and lid lock 50 engagement with the plunger 54 extended. The twist knob 64 is disposed on the underside of the lid lock 50. The knob 64 provides for the lid lock 50 to be opened from the interior 21 of the box. Inadvertent entrapment of a small person (not shown) is thereby avoided, as the person can turn the knob 64 to escape the interior of the invention 10. The release 58 on the interior of the lid lock 50 provides for retaining the lid lock 50 in an open position. The open position of the lid lock 50 has the plunger 54 in the retracted position. The release 58 is slid the opposite direction to release the plunger 54 to an extended position. The plunger 54 thereby locks the lid 22 when the lid 22 is closed to meet the box top 18. The plunger 54 locks against the catch 60 at the base of the top beveled edge 19. The recessed handle 30 is disposed within the lid 22. The handle 30 is proximal to the lid lock 50. The handle entry 31 is disposed within the handle 30. The handle grab 33 is within the handle entry 31. The interior radius of the handle grab 33 is comprised of a handle round 32. The handle entry 31, handle grab 33 and handle round 32 are identical in both the lid 22 recessed handle 30 and the access door 24 recessed handle 30. The lid handle surround 34 shields the handle 30 from the interior 21. The handle surround 34 comprises two spaced apart handle surround sides 36. The surround 34 further comprises two spaced apart handle surround ends 37 (FIG. 1). The handle surround back 38 completes the handle surround 34 enclosure of the recessed handle 30. The handle surround 34 prohibits inclement weather elements from entering the interior 21 of the invention 10.

Figure 3:
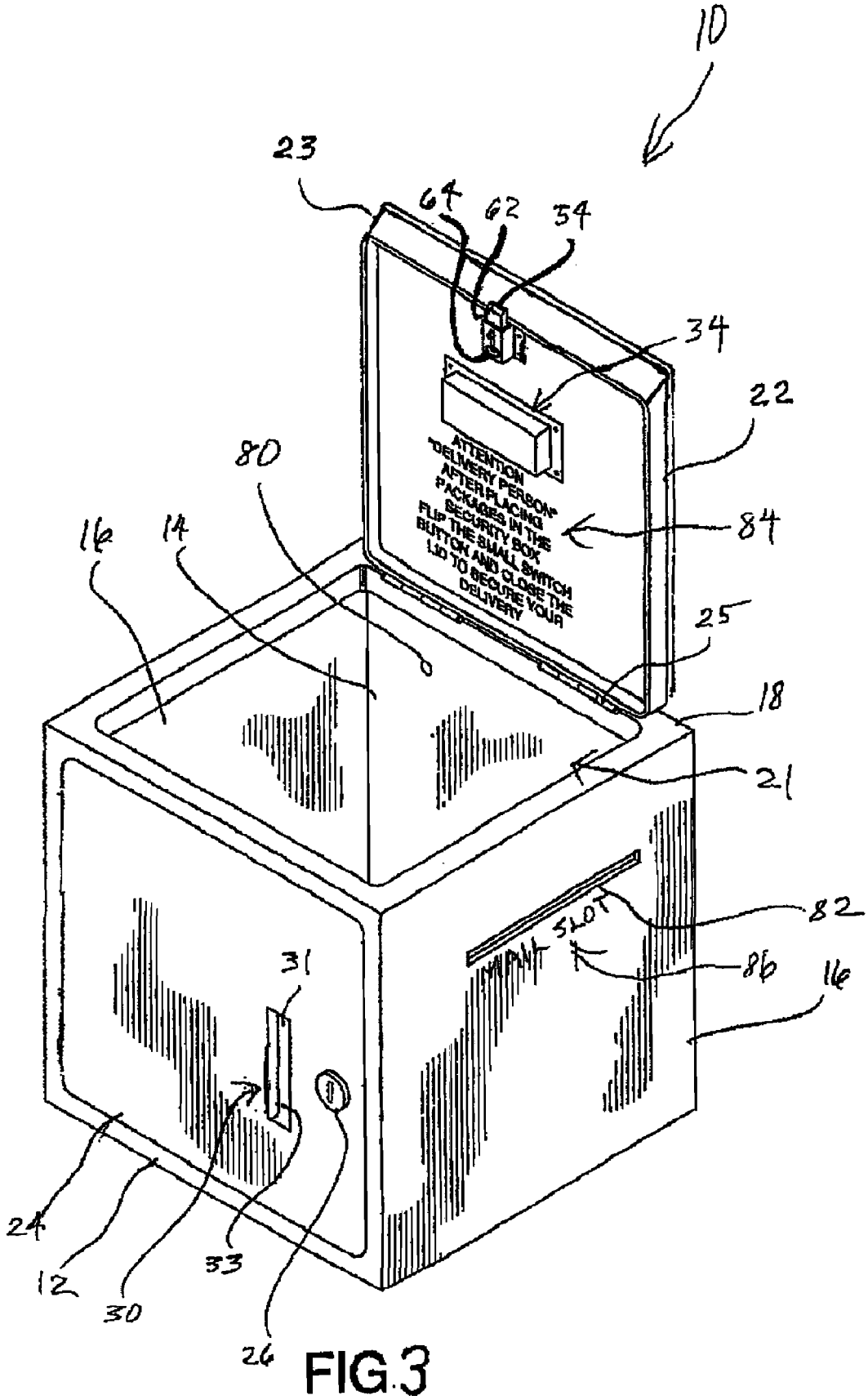
FIG. 3 is a perspective view of the invention with the lid open, illustrating instructions for a delivery person.

Referring to FIG. 3, the instructions 84 are disposed on the interior of the lid 22. The instructions 84 advise a delivery person (not shown) how to operate the invention 10. Optional spaced apart mounting holes 80 are disposed within the box back 14. The box side 16 further comprises a mail slot 82 with MAIL SLOT label 86.

Figure 4:
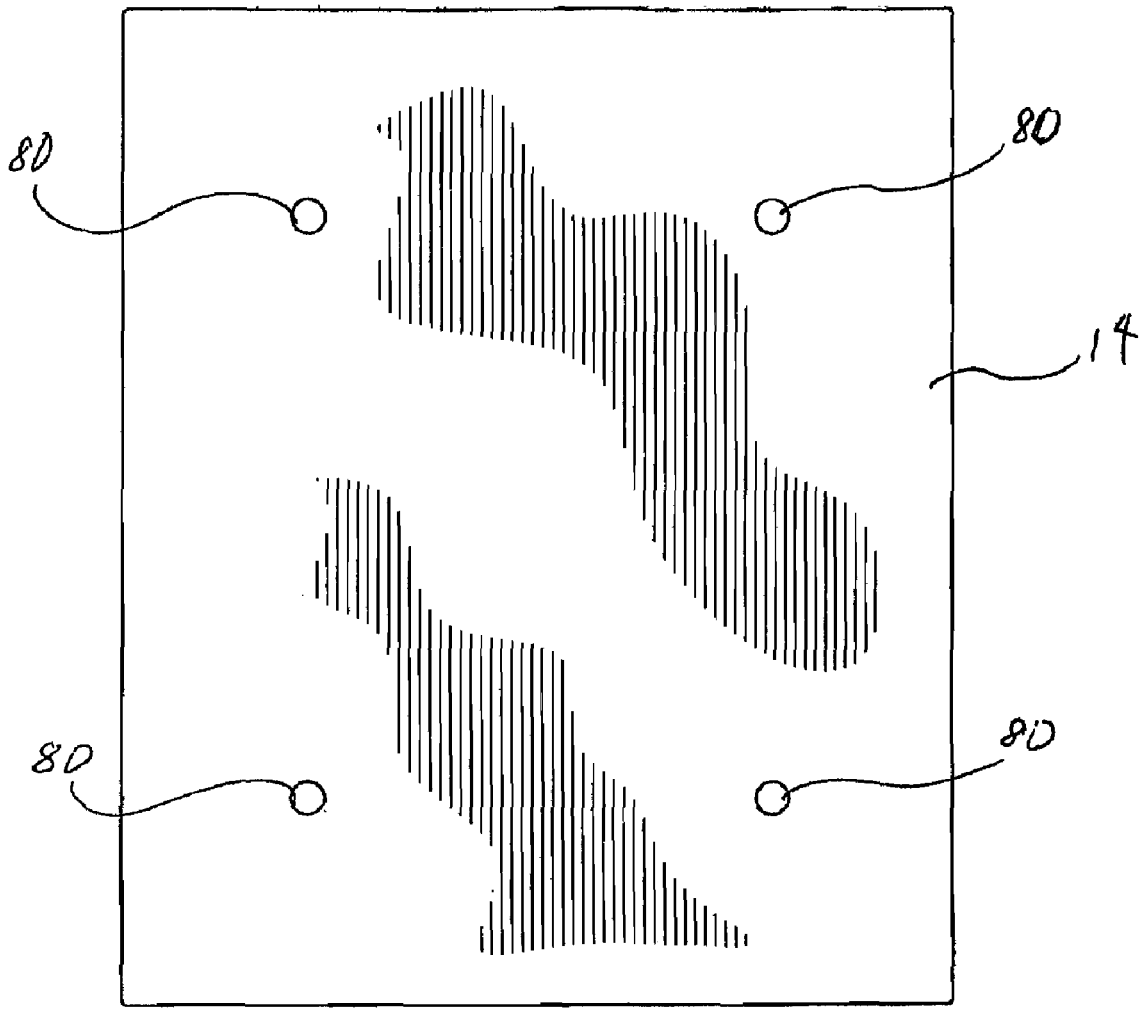
FIG. 4 is a back elevation view of the invention of FIG. 1, taken along the line 4—4.

Referring to FIG. 4, the holes 80 are spaced about 16 inches horizontally apart within the back 14 of the invention 10. The spacing of the mounting holes 80 provides for anchoring the invention 10 against a stationary object (not shown). The hole's 80 spacing is ideal for mounting to existing wall studs (not shown). Optional mounting holes 80 are also disposed within a bottom (not shown) of the box.

The invention 10 provides for received packages (not shown) to be securely retained within the interior 21 of the box. A delivery person finds the box lid 22 open, or, alternately, the box lid 22 closed with the plunger 54 held retracted by the release 58. The lid 22 is thereby pivotally accessible. Packages (not shown) are deposited within the interior 21 of the invention 10. The release 58 is slid to release the plunger 54. Released, the plunger 54 extends. The deliver person closes the lid 22. The plunger bevel 62 interacts with the top beveled edge 19 and provides for the plunger 54 to be compressed against the spring 56. The plunger 54 passes the catch 60, then extends via the spring 56 pressure to lock the lid 22 to the box top 18. The person (not shown) in charge of the key (not shown) for the access door 24 door lock 26 gains entry to the interior 21 via the access door 24. Any packages are contained securely within the invention 10. Entry to the interior 21 provides for easy access to turn the knob 64 of the lid lock 50. The lid 22 is thereby released for another delivery. The mail slot 82 provides for delivery of other typical items (not shown) such as letters, FedEx envelopes, AirBorne envelopes, UPS envelopes and the like and their secure storage within the invention 10.

With respect to the above description then, it is to be realized that the optimum dimensional relationships for the parts of the secure package receptacle, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A receptacle, the receptacle comprising:

a parallelepiped box, the box having a spaced apart top and bottom, a spaced apart front and back, and two spaced apart sides, thereby defining an interior therewithin;

an access door within the front of the box, the access door fitted flush with the box front;

a recessed handle within the access door;

a recessed handle disposed in an upper portion of each box side;

a door hinge pivotally attaching the access door to the front of the box;

a door lock for the access door;

a lid securing the top of the box, the lid having four sides, the lid fitted flush with the box top;

a lid hinge pivotally attaching a first side of the lid to the box top;

a lid beveled edge, the lid beveled edge on a side opposite the first side of the lid, the lid beveled edge about 30 degrees from vertical;

a recessed handle within the lid, the handle disposed proximal to the lid beveled edge;

a beveled edge of the box top for receiving the lid beveled edge, the beveled edge of the box top about 60 degrees from vertical, the beveled edge of the box top directly engaging and parallel to the lid beveled edge;

a lid lock for the lid.

2. The receptacle in claim 1 wherein the door hinge is concealed such that the door hinge is not visible from an exterior of the box.

3. The receptacle in claim 2 wherein the lid hinge is concealed such that the lid hinge is not visible from the exterior of the box.

4. The receptacle in claim 3 wherein the lid handle further comprises a lid handle surround, whereby inclement weather elements are prohibited from entering the box.

5. The receptacle in claim 4 wherein:

the lid handle further comprises:

a handle entry;

a handle grab within the entry;

a handle round on an interior radius of the handle grab;

the lid handle surround further comprises:

two spaced apart handle surround sides;

two spaced apart handle surround ends;

a handle surround back;

whereby the handle surround prohibits inclement weather elements from entering the box.

6. The receptacle in claim 5 wherein the access door handle further comprises an access door handle surround;

each side handle comprises a side handle surround, whereby inclement weather elements are prohibited from entering the box.

7. The receptacle in claim 6 wherein:

the access door handle further comprises:

a handle entry;

a handle grab within the entry;

a handle round on an interior radius of the handle grab;

each side handle further comprises:

a handle entry;

a handle grab within the entry;

a handle round on an interior radius of the handle grab;

the access door handle surround further comprises:

two spaced apart handle surround sides;

two spaced apart handle surround ends;

a handle surround back;

each side handle surround further comprises:

two spaced apart handle surround sides;

two spaced apart handle surround ends;

a handle surround back, whereby the handle surround prohibits inclement weather elements from entering the box.

8. The receptacle in claim 7 wherein the access handle surround further comprises a cutout;

each side box handle surround further comprises a cutout, thereby providing air access to the box.

9. The receptacle in claim 8 wherein each handle surround cutout is disposed within the handle surround back.

10. The receptacle in claim 8 wherein an additional handle surround cutout is disposed within:

the handle surround top end of the access door handle;

one of the handle surround ends of each box side handle.

11. The receptacle in claim 1 wherein the lid hinge is concealed such that the lid hinge is not visible from the exterior of the box.

12. A receptacle, the receptacle comprising:

a parallelepiped box, the box having a spaced apart top and bottom, a spaced apart front and back, and two spaced apart sides, thereby defining an interior therewithin;

an access door within the front of the box, the access door fitted flush with the box front;

a recessed handle within the access door;

a recessed handle disposed in each box side;

a door hinge pivotally attaching the access door to the front of the box;

a door lock for the access door;

a lid securing the top of the box, the lid having four sides, the lid fitted flush with the box top;

a lid hinge pivotally attaching a first side of the lid to the box top;

a lid beveled edge, the lid beveled edge on a side opposite the first side of the lid, the lid beveled edge about 30 degrees from vertical;

a recessed handle within the lid, the handle disposed proximal to the beveled edge;

a beveled edge of the box top for receiving the lid beveled edge, the beveled edge of the box top about 60 degrees from vertical, the beveled edge of the box directly engaging and parallel to the lid beveled edge;

a catch on a bottom of the box beveled edge;

a lid lock;

a lock plunger for engagement with the box beveled edge catch;

a compression spring acting to extend the lock plunger;

a plunger bevel on an end of the plunger, whereby the bevel provides for lid closure and lock engagement with the plunger extended;

a twist knob on an interior of the lid lock, whereby the lock can be opened from the interior of the box;

a release on an interior of the lid lock, whereby the release retains the lock in an open position until released;

instructions on the interior of the lid, the instructions for advising a delivery person;

a mail slot within the box;

spaced apart mounting holes within the box back, the holes spaced about 16 inches horizontally apart.

13. The receptacle in claim 12 wherein the door hinge is concealed such that the door hinge is not visible from an exterior of the box.

14. The receptacle in claim 13 wherein the lid hinge is concealed such that the lid hinge is not visible from the exterior of the box.

15. The receptacle in claim 14 wherein the lid handle further comprises a lid handle surround, whereby inclement weather elements are prohibited from entering the box.

16. The receptacle in claim 15 wherein:

the lid handle further comprises:

a handle entry;

a handle grab within the entry;

a handle round on an interior radius of the handle grab;

the lid handle surround further comprises:

two spaced apart handle surround sides;

two spaced apart handle surround ends;

a handle surround back, whereby the handle surround prohibits inclement weather elements from entering the box.

17. The receptacle in claim 16 wherein the access door handle further comprises an access door handle surround;

each box side handle further comprises a handle surround, whereby inclement weather elements are prohibited from entering the box.

18. The receptacle in claim 17 wherein:

the access door handle further comprises:

a handle entry;

a handle grab within the entry;

a handle round on an interior radius of the handle grab;

each side handle further comprises:

a handle entry;

a handle grab within the entry;

a handle round on an interior radius of the handle grab;

the access door handle surround further comprises:

two spaced apart handle surround sides;

two spaced apart handle surround ends;

a handle surround back;

each side handle surround further comprises:

two spaced apart handle surround sides;

two spaced apart handle surround ends;

a handle surround back, whereby the handle surround prohibits inclement weather elements from entering the box.

19. The receptacle in claim 18 wherein the access handle surround further comprises a cutout;

each side handle surround further comprises a cutout, thereby providing air access to the box.

20. The receptacle in claim 19 wherein each handle surround cutout is in the handle surround back;

an additional cutout within the handle surround top end of the access door handle;

an additional cutout within one of the ends of each box side handle surround.

* * * * *